United States Patent [19]

Vogl et al.

[11] 4,147,532

[45] Apr. 3, 1979

[54] PROCESS FOR PILOTING OR CONTROLLING A STEEL REFINING PROCESS

[75] Inventors: Ernst Vogl, Trofaiach; Klaus Kammerhofer, Leoben, both of Austria

[73] Assignee: Vereinigte Osterreichische Eisen- und Stahlwerke - Alpine Montan Aktiengesellschaft, Vienna, Austria

[21] Appl. No.: 816,205

[22] Filed: Jul. 15, 1977

[30] Foreign Application Priority Data

Aug. 4, 1976 [AT] Austria ..... 5780/76

[51] Int. Cl.[2] ..... C21C 5/30

[52] U.S. Cl. ..... 75/52; 75/60

[58] Field of Search ..... 75/52, 60

[56] References Cited

U.S. PATENT DOCUMENTS

| | | | |
|---|---|---|---|
| 3,574,598 | 4/1971 | Kern | 75/60 |
| 3,598,386 | 8/1971 | Murphy | 75/60 |
| 3,669,645 | 6/1972 | Oishi | 75/60 |
| 3,720,404 | 3/1973 | Carlson | 75/60 |

*Primary Examiner*—P. D. Rosenberg

*Attorney, Agent, or Firm*—Cushman, Darby & Cushman

[57] ABSTRACT

In a steel refining process control over the composition of the product is maintained in part by supplying blowing oxygen to the molten material in an amount predetermined for achieving FeO content which is required for slagging the manganese and phosphorus. Lime, if required, is added in accordance with the FeO content and the silicon content to give saturation in lime and in the quasi-ternary system CaO—FeO—$SiO_2$ at the final temperature of the metal.

2 Claims, No Drawings

PROCESS FOR PILOTING OR CONTROLLING A STEEL REFINING PROCESS

The present invention refers to a process for piloting or controlling a steel refining process, particularly a process for the production of low carbon steels having a carbon content below 0.1 percent by weight, in which all the charging materials are charged into the refining vessel at the beginning of the blowing process or refining process and the amounts of the charging materials and the amount of oxygen to be blown are determined in dependence on the nominal values of analysis, temperature and amount of the desired end product, on the one hand, and in dependence on the analyses and the temperatures of the charging materials, on the other hand.

Processes for piloting or controlling steel refining processes are already known. In such known piloting or controlling processes, the intended nominal composition and nominal temperature of the metal bath is only influenced by preselecting the amounts of charging materials to be charged into the refining vessel, the ratio of the amounts of said charging materials and the amount of oxygen blown onto the charge. Therefore, there exists the task to aim at the desired nominal values with high an accuracy by the measures taken at the very beginning of the refining process and thus to achieve a metallurgically and, therewith, also economically optimum steel production by steel refining processes. In known processes for piloting or controlling steel refining processes, substantially empiric or half-empiric correlations were made use of and the known models are frequently based on simplifying and thus inexact and partially thermodynamically incorrect presuppositions and describe always only a narrow range of the intended analytical values with sufficient accuracy.

It is the main object of the present invention to provide a process for piloting or controlling a steel refining process which is free of the drawbacks mentioned above and permits invariably exact control of the nominal composition, the nominal temperature and the nominal amount of the desired endproduct within a broad range. For this purpose, the present invention is essentially characterized in that blowing oxygen is supplied in an amount predetermined for achieving the FeO-content of the slag required for slagging the Mn and P, thereby preselecting the required FeO-content with a higher value as would result under the condition of an equilibrium between P and Mn, respectively, within the metal bath and within the slag, and in that lime, if required together with fluxes, is added in an amount, which corresponds, with consideration of the FeO-content and of the amount of $SiO_2$ to be expected in view of the amount of Si present in the charging materials, to the saturation in lime and, respectively, in dicalciumsilicate in the quasi-ternary system $(CaO)'$—$(FeO)'$—$(SiO_2)'$ at the final temperature of the metal bath, noting that the basicity of the slag is maintained greater than 2.8 and is, if required, adjusted at a value exceeding said value by adding lime and increasing the amount of blowing oxygen supplied, the amount of slag aimed at amounts to at least 50 kilograms per ton of pig iron and is, if required, adjusted by adding granulate (granulated slag) and the content of the crude steel in Mn is adjusted to at least 0.20 percent by weight and the content of the crude steel in P is adjusted to maximally 0.03 percent by weight and that the required final temperature of the metal bath is being adjusted by controlling the amount of cooling agents (scrap, ore) and the required amount of steel is being adjusted by controlling the amount of pig iron.

By the mentioned measures, the actual thermodynamic conditions are taken into account. It is particularly considered that Mn and P, which are aimed at to become slagged at the end of the process to predetermined nominal values, are not being distributed between slag and metal bath according to the thermodynamic equilibrium. Furthermore, by these measures and by the measure that lime, if required together with fluxes, is added in an amount which corresponds, with consideration of the FeO-content and of the amount of $SiO_2$ to be expected in view of the amount of Si present in the charging materials to the saturation in lime and, respectively, in dicalciumsilicate in the quasi-ternary system $(CaO)'$—$(FeO)'$—$(SiO_2)'$ at the final temperature of the metal bath, it is considered that the saturation of the slag in lime and dicalciumsilicate is dependent on temperature.

According to a preferred embodiment of the process according to the invention, the FeO-content of the slag as is required for slagging P and Mn is, for slagging P, selected according to the equation $$V_p = a * (FeO)^2 + b * (FeO) + \lambda, \quad (1)$$

in which $V_p$ is the slagging of P, and, by using the difference of the P-content of the pig iron and of the P-content of the initial sample and by considering the amount of slag, according to the equation $$V_p = \frac{P_R - P_V}{P_V^2} * FS * 2.29,$$

in which $P_R$ is the P-content of the pig iron, $P_V$ is the P-content of the initial sample, FS is a value representing the ratio of the amount of pig iron and of the amount of slag to be expected and 2.29 is a stoichiometric factor for the conversion of P to $P_2O_5$, and is, for slagging Mn, selected according to the equation $$V_{Mn} = a' * (FeO)^2 + b' * (FeO) + \lambda', \quad (2)$$

in which $V_{Mn}$ is the slagging of Mn, noting that the slagging of Mn ($V_{Mn}$) is, by using the difference of the Mn-content of the pig iron and of the Mn-content of the initial sample and by considering the amount of slag, being determined by means of the equation $$V_{Mn} = \frac{Mn_R - Mn_V}{Mn_V} * FS * 1.29,$$

in which $Mn_R$ is the Mn-content of the pig iron, $Mn_V$ is the Mn-content of the initial sample and 1.29 is a stoichiometric factor considering that the slag contains Mn as MnO and FS has the meaning given above, noting that the coefficients a, b, d, a', b' and c' assume the values $a = -53.539$, $b = 3783$, $c = -41216$, $a' = -0.031$, $b' = 3.2118$, $c' = -4.2$ in the LD-process and assume the values $a = -73.593$, $b = 4075$, $c = -32077$, $a' = -0.0415$, $b' = 3.995$, $c' = -5.8$ in the OBM-process (bottom-blowing converter), said FeO-content being aimed at or piloted by preselecting the amount of lime added and the amount of supplied blowing oxygen as is required for achieving said FeO-content, noting that that higher FeO-content is being aimed at or piloted, which results from the equations (1) and (2) for attaining the refining vessel prescriptions, and that too low a Mn-content possibly resulting is brought to the desired value by adding Mn.

Therefore, the operation is substantially the following: In the first place the slagging of P and Mn, respectively, is calculated by assuming a value for the ratio of the amount of pig iron to the amount of slag to be expected. From the calculated values for the slagging of P and Mn, respectively, the FeO-content of the slag can be determined as is required for such slag. In knowledge of the amount of $SiO_2$ to be expected, a quite definite value for the CaO-content to be aimed at or piloted and thus for the amount of lime to be supplied does, within the quasi-ternary system $(CaO)'$—$(FeO)'$—$(SiO_2)'$, correspond to this FeO-content. In view of this ternary system not completely describing the slag, which does contain also other components such as $Fe_2O_3$, MnO, $P_2O_5$, $Al_2O_3$ and MgO, a corrective factor $f_{qt}$ must be defined for considering the actual composition of the slag. This value for $f_{qt}$ is being subsequently improved according to an iterative calculation method until all existing boundary conditions are complied with and the improved corrective factor is then being used for calculating the required amount of lime to be supplied. In this case, the operation is, according to a preferred embodiment, such that, if the FeO-content required for slagging of P and/or Mn is greater than a limiting value for the FeO-content characteristic for the final bath temperature, saturation of the slag in lime at the final bath temperature is aimed at or piloted by preselecting the amount of lime added, and that, if the FeO-content required for slagging P and/or Mn is smaller than a limiting value for the FeO-content characteristic for the final bath temperature, saturation of the slag in dicalciumsilicate at the final bath temperature is aimed at or piloted by preselecting the amount of lime added and the amount of blowing oxygen supplied. This limiting value can be assumed to have the value $FeO'_{Gr}$ = 191.913–0.103 T.

In case that saturation of the slag in lime is being aimed at for the intended final bath temperature, by preselecting the amount of lime added a CaO-content of the slag is adjusted which amounts, on a percent basis, to $$f_{qt} * [100 - (FeO' + SiO_2')],$$

noting that the value for FeO' is obtained from the FeO-content required for slagging P and/or Mn by using the equation $$FeO' = \frac{FeO}{f_{qt}}$$

and that the value for $SiO_2'$ is calculated by using the equation $$SiO2' = 2 * \left[ -\frac{b_1 - 1.732}{2 * a_1} - \sqrt{\left(\frac{b_1 - 1.732}{2 * a_1}\right)^2 - \frac{c_1 + 1.732 * FeO'}{a_1}} - FeO \right] \quad (1)$$

in which the coefficients $a_1$, $b_1$ and $c_1$ are temperature-dependent and assume the values $$a_1 = -3.274 * 10^{-7} * T^2 + 1.095 * 10^{-3} * T - 0.90835$$

$$b_1 = 3.135 * 10^{-5} * T^2 - 0.1045 * T + 85.712$$

$$c_1 = -7.3687 * 10^{-4} * T^2 + 2.4168 * T - 1931.48$$

noting that the corrective factor $f_{qt}$ for the three components FeO, $SiO_2$ and CaO, in relation to the total slag, is equal to $$100 * \frac{CaO + SiO_2}{(100 - FeO')*(CaO + SiO_2 + FeO + Fe_2O_3 + MnO + MgO + P_2O_5 + Al_2O_3)} *0.99$$

and must fulfill the condition that $$\left[ (CaO + SiO_2 + FeO + Fe_2O_3 + MnO + MgO + P_2O_5 + Al_2O_3)/0,99 - \frac{CaO + SiO_2}{100 - FeO'} * \frac{100}{f_{qt}} \right] < 0.1$$

In the other case, in which saturation of the slag in dicalciumsilicate is aimed at for the intended final bath temperature, by preselecting the amount of lime added a CaO-content is adjusted which amounts, on a percent basis, to $$f_{qt} * [100 - (FeO' + SiO_2)],$$

noting that the value for FeO' is obtained from the FeO-content required for slagging P and/or Mn by using the equation $$FeO' = \frac{FeO}{f_{qt}}$$

and that the value for $SiO_2$ is calculated by using the equation $$SiO_2' = 2 * \left[ -\frac{b_2 - 1.732}{2 * a_2} + \sqrt{\left(\frac{b_2 - 1.732}{2 * a_2}\right)^2 - \frac{c_2 + 1.732 * FeO'}{a_2}} - FeO' \right] \quad (2)$$

in which the coefficients $a_2$, $b_2$ and $c_2$ are temperature-dependent and assume the values $$a_2 = -5.61 * 10^{-6} * T^2 - 1.7528 * 10^{-2} T - 13.775$$

$$b_2 = 1.833 * 10^{-4} * T^2 - 0.5733 * T + 451.327$$

$$c_2 = -1.4833 * 10^{-3} * T^2 + 4.6225 * T - 3592.54$$

noting that the corrective factor $f_{qt}$ for the three components FeO, $SiO_2$ and CaO, in relation to the total slag is equal to $$100 * \frac{CaO + SiO_2}{(100 - FeO')*(CaO + SiO_2 + FeO + Fe_2O_3 + MnO + MgO + P_2O_5 + Al_2O_3)} *0.99$$

and must fulfill the condition that $$\left[(CaO + SiO_2 + FeO + Fe_2O_3 + MnO + MgO + P_2O_5 + Al_2O_3)/0.99 - \frac{CaO + SiO_2}{100 - FeO'} * \frac{100}{f_{qt}}\right] < 0.1$$

Preferably, the amount of slag is, if necessary by adding granulate (granulated slag), piloted to a value of more than 50 kilograms per ton of pig iron after having selected the amount of lime to be supplied with respect to the saturation of the slag in lime and, respectively, dicalciumsilicate, under consideration of the amount of FeO required for slagging P and/or Mn and under consideration of the corrective factor ($f_{qt}$) for the components CaO, FeO and $SiO_2$, in relation to the total slag, noting that there results a specific amount of slag $$M_{SL} = \frac{CaO + SiO_2}{100 - FeO'} * \frac{100}{f_{qt}} \text{ kg/t}$$

and that the amount of granulate to be added, if necessary, is being determined by using the equation $$M_{GR} = 50 - \frac{CaO+SiO_2}{100 - FeO'} * \frac{100}{f_{qt}} \text{ [kg/t]}$$

and further noting that granulate is added only for positive values for $M_{GR}$ and that the ratio (FS) of the amount of pig iron to the amount of slag is being made the basis for calculating the amount of FeO required for slagging P and/or Mn and the obtained corrected value for the amount of FeO is aimed at or piloted by preselecting the amount of lime added and the amount of blowing oxygen. The ratio FS is defined by the equation $$FS = \frac{1000}{M_{SL}} \text{ kg pig iron/kg slag,}$$

in which $M_{SL}$ is the amount of slag in kg/t (kilograms per tons). In this case, the basicity $$B = \frac{CaO'}{SiO_2'}$$

of the slag can be piloted to a value of more than 2.8 by preselecting the amount of lime, of blowing oxygen and, if desired, of fluor spar, noting that the preselected amount of lime to be added is ruled by the equation $$M_K = (Si_R * 21.393 * \frac{CaO'}{SiO_2'} - CaO_{zus}) * \frac{100}{CaO_K * 0.95} \text{ [kg/t],}$$

in which $Si_R$ is the Si-content of the pig iron, $CaO_{zus}$ is the amount of CaO supplied by the charging materials other than lime as expressed in kg/t and $CaO_K$ is the CaO-content of the lime.

If the CaO-content of the slag is to be piloted to a value exceeding 60 percent by weight, flux or fluxes are being added in an amount of $$M_{FS} = 0.5 + \frac{M_{SL} * (CaO' - 60)}{100} * 0.2 \cdot \text{kg/t}$$

According to a preferred embodiment, cooling agents are added in an amount to compensate the amount of heat which exceeds that required for attaining the intended final bath temperature, noting that the amount of cooling agent to be supplied is determined by the equation $$M_{KM} = \frac{\Delta Q}{f_1 + f_2 + f_3} \text{ kg/t,}$$

noting that, when using scrap as cooling agent, the equations $$f_1 = [0.17 - 0.0126*(C_{SC} - 0.05)]*(1500 - T_{SC})$$

$$f_2 = 66 - 4.81*(C_{SC} - 0.05)$$

ti $f_3 = 0.23*(T - 1500)$ apply and that, when using ore as cooling agent, the equations $$f_1 = (920*g_{Fe_2O_3} + 865*g_{FeO})/100$$

$$f_2 = (100 - g_{Fe_2O_3} - g_{FeO})*(0.26*T + 40)/100$$

$$f_3 = (427.5*g_{Fe_2O_3} + 316.6*g_{FeO})/100$$

apply, in which $C_{SC}$ is the carbon content of the scrap, $T_{SC}$ is the temperature in ° C. of the scrap supplied, T is the final bath temperature in ° C., $g_{FeO}$ is the FeO-content of the ore and $g_{Fe_2O_3}$ is the $Fe_2O_3$-content of the ore. The term $\Delta Q$, which is used for determining the amount of cooling agent, results from the heat balance of the refining process.

The required amount of pig iron can be determined by means of equation $$M_{RE} = \frac{SM}{M_{Fe}} * 1000\ t$$

wherein $M_{Fe}$ is the total amount of iron supplied and remaining within the metal bath and expressed in kilogram per ton pig iron, $M_{Re}$ is the amount of pig iron in tons and SM is the nominal amount (intended amount) of steel in tons.

For warranting an extensive decoupling of the effects of the individual adaptation components when repeatedly and correctively optimizing the piloting process or controll process of the invention, the adaptation factors are, in contrast to the usual calculating process, made use of according to the following sequence:

| | |
|---|---|
| I Oxygen balance: | $O_g = O_V - O_{in} + ADO$ |
| ↓ | |
| II heat balance: | $Q = Q_{in} - Q_{out} + ADQ$ |
| ↓ | |
| III iron balance: | $M_{Fe} = M_{Rd} + M_{Sc} + M_{Feore} + ADF$ |

In these balances $O_g$ is the required blowing oxygen in $Nm^3$/t pig iron ($Nm^3$ means standardized $m^3$), $O_V$ is the total oxygen requirement, $O_{in}$ the oxygen supplied by the charging materials and expressed in $Nm^3$/t pig iron, $Q_{in}$ the heat supplied by the charging materials in kcal/t pig iron, $Q_{out}$ the heat requirement in kcal/t pig iron, ADO the adaptation factor for the oxygen balance in $Nm^3$/t pig iron, ADQ the adaptation factor for the heat balance in kcal/t pig iron, ADF the adaptation factor for the iron balance in kg/t pig iron and $M_{Rd}$ the iron supplied to and remaining within the bath reduced by the amount of scrap ($M_{Sc}$) and by the amount of iron supplied by ore ($M_{Feore}$).

All these measures are equally suitable for bottom blowing refining processes as well as for surface blowing refining processes. These measures allow to take into account the most differing production programs of a steel plant. In view of the process according to the invention being based on a mathematical analytical process description, the accuracy of the piloting measures is over a broad range of the individual intended quantities superior to the accuracy achievable with known process piloting methods based on empiric or half-empiric process descriptions. The basic mathematic analytic relations permit the use of electronic computers for starting and monitoring the piloting measures to be effected. The prescriptions for the refining vessel content are complied with higher an accuracy than up till now and an increase in productivity for the production plants is achieved by minimizing the refining periods and, further the economy of operation is improved by maximizing the metal output and by optimizing the combination of charging materials. The efects of the piloting measures are, in the process according to the invention, exactly reproducible and near the optimum also with intended quantities varying within a broad range.

Monitoring or piloting, respectively, of the composition and of the amount of the slag phase assumes a central position in ruling losses of iron and alloying elements by oxydation and in ruling the material balance and the heat balance of refining processes.

Based on this fact, there was developed for the inventive process for piloting refining proceses, the exact determination of the required final composition and of the required amount of the refining slag for any specific charge by aiming at or piloting this composition and amount by preselecting the amounts of charging materials and of blowing oxygen for optimizing the steel production.

In a first step, the FeO-content of the final slag is determined which is, in dependence on the selected priority, required for the required slagging of phosphorous and manganese, respectively. In contrast to processes known up till now, which are based on an equilibrium condition of the P-reaction and of the Mn-reaction, respectively, at the end of the process, the process according to the invention takes in consideration that the P-reaction and the Mn-reaction can, particularly with low carbon steels, no more follow any change in the composition and amount of slag at the end of the process. Additionally, the severe influence of the charge-specific amount of slag in the initial charge, which is bsed on practical test results, was also considered whereas a temperature within the usually intended range of final bath temperatures has no detectable influence.

In an iterative algorithm, the FeO-content of the slag matching the prescriptions with respect to phosphorous and manganese is being determined, noting that restrictive conditions with respect to the FeO-content maximally or minimally, respectively, admissible are being incorporated on ground of metallurgical and economical reasons and limits, if any, of the prescriptions for P and Mn, respectively. The adaptation factors permit to adapt piloting or control of the process to different refining processes and operation modes.

A plurality of investigations proves that a refining process can be performed in a particularly economic manner if the refining slags tend to reach at the end of the process the saturation condition for lime and dicalciumsilicate, respectively.

In the process according to the invention, the final composition of the refining slag is being piloted to that final condition of saturation in lime and dicalciumsilicate, which corresponds to the FeO-content resulting from the desired slagging of manganese and phosphorous, respectively, because only such final condition warrants metallurgically and economically optimum results of the refining process in view of the resulting FeO-content of the slag, which is the minimum required FeO-content, having as an effect a maximum output of metal, a minimum blowing period and a minimum wear of the cladding of the refining vessel.

In view of the complete analytic description of the shape of the lime saturation surface within the system $(CaO)'$—$(FeO)'$— $(SiO_2)'$ in dependence on the temperature being effected within the process according to the invention, there is permitted an exact determination of the slag portions $(CaO)'$, $(FeO)'$ and $(SiO_2)'$ within the quasi-ternary system. In view of the exact calculation of composition and amount of slag at the end of the refining process having subsequently a decisive influence on the truth of the subsequent material and heat balances, a charge-specific calculation of the final analyses and of the final amount of the refining slag was effected in contrast to processes known up till now in which according to a simplified assumption the sum of the contents ($CaO + FeO + SiO_2$) was given an invariably constant value. In this manner, piloting of the final refining slag becomes, according to the invention, possible by preselecting the amounts of charging materials and the amount of blowing oxygen.

The recurrence algorithm used in the process according to the invention and essentially being based on a stepwise approximation of the composition and amount of the slag as calculated from two different statements, is schematically illustrated on page 18 and permits a substantially higher accuracy when establishing the slag balance.

Comparisons of detailed slag analyses obtained in steel plants of applicant (table I) prove that, deviating from the fixed presupposition for all charges that $CaO + FeO + SiO_2$ of the slag is a constant value (which presupposition is made use of in all processes known up till now by assuming in most cases a value within the range of 80 to 84%), the illustrated calculating method for determining the charge-specific final analysis of the refining slag and, based thereon, for determining the total amount of slag is significant and necessary for an effective control of refining processes. Based on the exact calculation of the charge-specific composition and amount of the final refining slag, there can be aimed at or piloted the optimal and specific amount of slag required for slagging phosphorous and manganese as well as the optimum basicity of the slag, thereby considering restrictive conditions with respect to the minimum required basicity and amount of slag for piloting the amount of slagging agents (particularly lime) and fluxes (particularly fluor spar) to be supplied.

The non-dissolved and thus metallurgically ineffective portion of the lime can, according to interpretations of slag analyses (table II) for low carbon steels, be considered as constantly low. The additional amount of lime, which does not become dissolved, is thus of less importance than that amounts of lime which are being added for compensating blast losses and for sparing the cladding of the refining vessel.

The FeO-content of the slag, which is required for piloting he required minimum basicity of 2.8 of the slag, can be calculated by using the following equations.

(a) Saturation in lime:

$$x = -\frac{b_1 + 0.262}{2 * a_1} - \sqrt{\left(\frac{b_1 + 0.262}{2 * a_1}\right)^2 + \frac{26.236 - c_1}{a_1}}$$

(b) Saturation in dicalciumsilicate:

$$x = -\frac{b_2 + 0{,}262}{2 * a_2} + \sqrt{\left(\frac{b_2 + 0.262}{2 * a_2}\right)^2 + \frac{26.236 - c_2}{a_2}}$$

$$y = 0.262 * (100 - x)$$

$$FeO' = x - y/tg\ 60$$

$$FeO = FeO' * f_{qt}$$

$$SiO_2' = \frac{2y}{tg60}$$

$$CaO' = 100 - x - \frac{y}{tg60}$$

Thereby the slag basicity is being calculated by using the FeO-content required for slagging of P and/or Mn, noting that, if too low a slag basicity results when using this FeO-content, the necessary corrections are being made on the charging materials.

Charge-specific calculation of the final analysis and the final amount of slag.

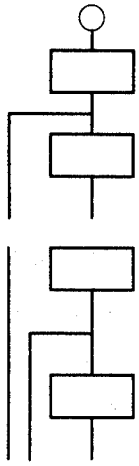

-continued

Charge-specific calculation of the final analysis and the final amount of slag.

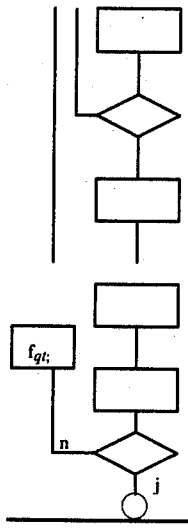

Table I slag analyses of the LD3-process

| Chnr. | (CaO+FeO+$SiO_2$) [%] |
|---|---|
| 509027 | 70.61 |
| 509028 | 74.46 |
| 509029 | 73.56 |
| 509030 | 73.38 |
| 509031 | 71.82 |
| 509691 | 73.35 |
| 509692 | 75.23 |
| 509693 | 73.39 |
| 509694 | 72.62 |
| 509695 | 72.13 |
| 509696 | 74.70 |
| 509697 | 73.54 |
| 509698 | 69.91 |
| 509699 | 67.08 |
| 509700 | 66.88 |

Table II undissolved portions of lime in LD3-slags

| Chnr. | CaO wasserlosl.[%] |
|---|---|
| 509691 | 5.05 |
| 509692 | 6.37 |
| 509693 | 3.70 |
| 509694 | 4.52 |
| 509695 | 4.22 |
| 509696 | 6.80 |
| 509697 | 5.77 |
| 509698 | 4.33 |
| 509699 | 6.08 |
| 509700 | 4.66 |

The imperative importance of an optimum adjustment of the FeO-proportion within the final slag for warranting the required slagging of manganese and phosphorous as well as the most important flux for dissolving the added amounts of lime is, in the process according to the invention and in contrast to processes known up till now, taken into account by piloting the required FeO via the amount of blowing oxygen and simultaneously by piloting the final composition of the slag corresponding to its saturation in lime via the preselected optimum amount of lime added and thereby attaining an end condition of the refining process which warrants the required slagging of phosphorous and manganese, the required desulfurization and the required decarburization as well as the economically most favourable combination of the charging materials.

Piloting of the refining processes, within the scope of the present invention, to attain a final condition equilibrated with respect to material requirements and thermal requirements is made possible by the iron balance, the oxygen balance and the heat balance of the piloting method being based on the exact, charge-specific slag balance. When piloting the process, up to five types of scrap (low carbon steels, medium carbon steels, high carbon steels, low alloyed steels and high alloyed steels), two types of ores, two types of lime as well as liquid pig iron, solid pig iron, fluor spar, bauxite, lime stone, dolomite, granulated slag, roll mill scale were provided and thereby taking into account any possibility for flexible adaptation to broader conditions. For achieving the intended high accuracy of the desired material balance and the desired heat balance, the degree of oxydation of the slag (particularly $Fe_2O_3/FeO$) as well as the composition of the effluent gases (particularly $CO/CO_2$) were incorporated within the calculations. In view of the detailed calculation of the slag analysis and amount of slag within the slag balance it becomes possible to more exactly describe the balance components correlated to the slag within the iron balance and the oxygen balance and, particularly, to minimize that residual balance components within the heat balance by an analytically clear determination of the slag enthalpy which remain in processes known up till now and thus to perform a perfect method for piloting the starting conditions of the refining process by preselecting that starting amounts of iron sources, slagging agents, blowing oxygen and cooling agents which are subjected to a far less uncertainty.

If there are observed during the operating procedure of the refining processes, i.e. prior to starting blowing of oxygen, any alterations of short duration, particularly on account of deviations of the nominal value of the process from the analyses and temperatures of the charging materials as having been made the basis of the piloting process and, respectively, the prescribed amounts of starting materials, the piloting process according to the invention is in the position to perform, prior to the very beginning of the refining process, control steps or piloting steps in an arbitrary number for compensating any changed boundary conditions for the purpose of maintaining a refining operation resulting in the intented quantities or the quantities aimed at. This applies, above all, to a variation of the preselected amount of blowing oxygen and the preselected amount of cooling agent, so that an optimum operation of the refining process can be maintained.

The piloting of the refining process, being based on continuously actualizing the piloting process by adaptive possibility to further development, allows to maintain an optimum piloting strategy irrespective of short-timed or long-timed variations of the refining process. In view of the possibility of adaptation to the slagging of manganese, phosphorous and sulphur as well as to the iron balance, the oxygen balance and the heat balance and further in view of the decoupling of the effects of single adaptation components within the most important process conditions, a continuous, rapid and effective response of the piloting process to system variations of the refining process can be secured and further it is made possible to take external measures for compensating non-quantitizable influences.

For further subsequent piloting processes (collecting charge = Fangcharge, alloying process), which can be adjoined in form of blocks to the corresponding piloting algorithms without influencing the existing configuration, the process parameters to be transmitted at the transmitting terminals are already made available by the piloting process according to the invention (f.i. oxygen dissolved within the steel, solubility of lime, amount of scrap dissolved and so on).

The present invention is subsequently further illustrated with reference to embodiments of the process according to the invention.

EXAMPLE 1

| | | |
|---|---|---|
| Prescriptions for the refining vessel: | | |
| Carbon | 0.05 | % |
| minimum admissible Mn | 0.2 | % |
| Phosphorous | 0.013 | % |
| Sulphur | 0.025 | % |
| Temperature | 1600 | ° C. |
| amount of steel | 126.6 | t |
| pig iron: | | |
| Carbon | 4.29 | % |
| Silicon | 0.45 | % |
| Manganese | 1.21 | % |
| Phosphorous | 0.105 | % |
| Sulphur | 0.036 | % |
| Temperature | 1259 | ° C. |

(a) In view of the higher priority for attaining the and, respectively, falling short of the required final phosphorous content of the crude steel, the FeO required for slagging phosphorous is calculated according to the equation $$FeO\ (\Delta P) = 19.74\% \text{ with } P_{initial\ sample} = 0.0129\% \quad (1a)$$

This FeO-content of the slag simultaneously results in such a slagging of manganese which leads to a final content of the crude steel in manganese of $$Mn_{initial\ sample} = 0.26\%, \quad (1b)$$

noting that the restrictions with respect to the minimum admissible Mn-content of the crude steel as well as the maximum and minimum reasonable FeO-content of the slag is taken into account.

(b) The final composition of the slag, which corresponds to the intended FeO-content at a final temperature of 1600° C., is, for the quasi-ternary system (CaO)'—(FeO)'—$(SiO_2)'$, calculated as $$(CaO)' = 56.5\% \quad (2)$$

$$(FeO)' = 27.5\%$$

$$(SiO_2)' = 16.0\%$$

when aiming at or piloting the lime saturation isotherm according to the invention.

(c) In a detailed slag balance established by a recurrence method, the specific amount of slag per ton pig iron is, when considering all charging materials, $$MSL_{sp} = 100.43 \text{ kg/t pig iron} \quad (3)$$

(d) The exact final composition of the slag is calculated as

| | | | |
|---|---|---|---|
| (4) | CaO | = | 40.48% |
| | FeO | = | 19.74% |

-continued

| | | |
|---|---|---|
| $SiO_2$ | = | 11.46% |
| $Fe_2O_3$ | = | 7.90% |
| MnO | = | 13.86% |
| MgO | = | 3.20% |
| $P_2O_5$ | = | 2.37% |
| $Al_2O_3$ | = | 0.08% |
| Sum | = | 99.09% |

The sum of CaO + FeO + $SiO_2$ = 71.68% drastically justifies the inventive, charge-specific calculation of the amount and analysis of the slag as compared to inflexible presuppositions of f.i. CaO + FeO + $SiO_2$ = 82%. The piloted degree of basicity of $CaO/SiO_2$ = 3.53 for the final refining slag meets the restrictions with respect to the minimum admissible basicity.

(e) Now, as the first piloting quantity for piloting the final composition of the slag, which has been recognized as being an optimum, there is calculated the specific amount of lime to be added per ton of pig iron.

$$Mlime_{spec} = 45.18 \text{ kg/t pig iron} \quad (5)$$

(f) The final carbon content of the metal bath is, based on the piloted final FeO-content of the slag and the established FeO-activity, calculated as $$C_{initial\ sample} = 0.054\%$$

(g) By means of a sulphur balance and under consideration of the influence of the charge-specific amount of slag, of the slag basicity, of the FeO-content of the slag as well as of the final bath temperature, the final sulphur content of the metal bath becomes $$S_{initial\ sample} = 0.026\% \quad (7)$$

(h) Within the now following balancing portion of the charge model, the material balance and the heat balance of the refining process is being established, thereby considering all the charging materials required for refining processes and further considering the slag balance. Simultaneously, there was considered the supply of

| | | |
|---|---|---|
| (8) | fluor spar | 100 kg |
| | granulated slag | 1000 kg |
| | solid pig iron | 4000 kg |

which was prescribed by operation modes according to service instructions.

(i) The iron balance gives the specific iron input per ton of pig iron (losses and scrap substracted) which remains within the bath.

$$Fe_{in}^* = 915.2 \text{ kg/t pig iron}$$

(j) The oxygen balance gives the specific amount of required blowing oxygen according to $$O_{2\ spec} = 58.37 \text{ Nm}^3\text{/t pig iron} \quad (10a)$$

as well as the specific amount of waste gases according to $$V_g = 82.2 \text{ Nm}^3\text{/t pig iron} \quad (10b)$$

(k) The most important items of the heat balance assume by calculation the following values

| | | |
|---|---|---|
| (11a) | oxydation of iron and iron companions | 244 035 kcal/t pig iron |
| | sensible heat of the pig iron | 262 070 kcal/t pig iron |
| (11b) | sensible heat of the crude steel | 297 252 kcal/t pig iron |
| | sensible heat of the slag (enthalpy 455 kcal/kg charge-specific) | 45 588 kcal/t pig iron |
| | sensible heat of the waste gases | 42 428 kcal/t pig iron |

The remaining heat excess of $$\Delta Q = 106\ 846 \text{ kcal/t pig iron} \quad (11c)$$

must be compensated by means of cooling agents. When operating the process with mill scrap (recycled scrap) the specific scrap addition is $$MSC_{spec} = 313.7 \text{ kg/t pig iron} \quad (11d)$$

(l) Based on the total iron input remaining within the bath, which amounts to $$Fe_{in} = 1233.9 \text{ kg/t pig iron,} \quad (12a)$$

the total amount of pig iron required for obtaining the nominal weight of crude steel becomes $$MPI = 102.6 \text{ tons} \quad (12b)$$

(m) Therewith, as further piloting quantities, there result the total amounts to be supplied according to $$\text{scrap MSC} = 32.18 \text{ t} \quad (13a)$$

$$\text{lime } M_K = 4635.0 \text{ kg}$$

$$\text{blowing oxygen } VO_2 = 5988 \text{ Nm}^3$$

With 100 kg fluor spar,
1000 kg granulated slag and
4000 kg solid pig iron added, noting that there result 10.3 t total amount of slag and 8617 $Nm^3$ total amount of waste gases

EXAMPLE 2

| | | |
|---|---|---|
| Prescriptions for the refining vessels: | | |
| Carbon | 0.05 | % |
| Manganese | 0.3 | % |
| Phosphorous | 0.03 | % |
| Sulphur | 0.025 | % |
| Temperature | 1630 | ° C. |
| Amount of steel | 118 | t |
| pig iron: | | |
| Carbon | 4.1 | % |
| Silicon | 0.45 | % |
| Manganese | 1.08 | % |
| Phosphorous | 0.098 | % |
| Sulphur | 0.04 | % |
| Temperature | 1213 | ° C. |

(a) In view of the non-critical phosphorous prescription in this example, the manganese prescription is the critical parameter for piloting the minimum required FeO-content of the slag.

$$FeO\ (\Delta Mn) = 15.95\% \text{ at } Mn_{initial\ sample} = 0.3\% \quad (1a)$$

$$P_{initial\ sample} = 0.019\% \quad (1b)$$

This means that the FeO to be piloted or aimed at for attaining the required slagging of Mn, P becomes slagged to a vaster extent than required.

(b) Resulting composition of the slag in the quasi-ternary system $$(CaO)' = 59.1\% \quad (2)$$

$$(FeO)' = 22.1\%$$

$$(SiO_2)' = 18.8\%$$

(c) Specific amount of slag $$MSL_{sp} = 85.17 \text{ kg/t pig iron} \quad (3)$$

(d) Final composition of the slag as piloted or aimed at.

| | | |
|---|---|---|
| (4) | CaO | = 42.61 % |
| | FeO | = 15.95 % |
| | $SiO_2$ | = 13.54 % |
| | $Fe_2O_3$ | = 7.38 % |
| | MnO | = 13.77 % |
| | MgO | = 3.64 % |
| | $P_2O_5$ | = 2.20 % |
| | $Al_2O_3$ | = 0.09 % |
| | Sum | = 99.18 % |
| | $(CaO+FeO+SiO_2)$ | = 72. % |
| | $\frac{CaO}{SiO_2}$ | 3.14 |

(e) Specific amount of lime $$Mlime_{spec} = 40.32 \text{ kg/t pig iron} \quad (5)$$

(f)

$$C_{initial\ sample} = 0.049\% \quad (6)$$

(g)

$$S_{initial\ sample} = 0.028\% \quad (7)$$

(h)

| | | |
|---|---|---|
| fluor spar | 100 kg | (8) |
| granulated slag | 1000 kg | |
| solid pig iron | 4500 kg | |

(i) Iron input (losses and scrap substracted)

$$Fe_{in}^{*} = 927.3 \text{ kg/t pig iron} \quad (9)$$

(j) Specific amount of blowing oxygen $$O_{2spec} = 54.58 \text{ Nm}^3\text{/t pig iron} \quad (10a)$$

specific amount of waste gases $$V_g = 78.96 \text{ Nm}^3\text{/t pig iron} \quad (10b)$$

(k) Items of the heat balance

| | | |
|---|---|---|
| (11a) | Oxydation of iron and iron companions | 225256 kcal/t pig iron |
| | sensible heat of the pig iron | 251 490 kcal/t pig iron |
| (11b) | Sensible heat of the crude steel | 307 596 kcal/t pig iron |
| | sensible heat of the slag (enthalpy 462 kcal/kg charge-specific) | 39 444 kcal/t pig iron |
| | sensible heat of the waste gases | 41 698 kcal/t pig iron |

specific excess of heat $$\Delta Q = 84\ 020 \text{ kcal/t pig iron} \quad (11c)$$

specific amount of scrap $$MSC_{spec} = 241.2 \text{ kcal/t pig iron} \quad (11d)$$

(l) Iron input remaining within the bath $$Fe_{in} = 1168.5 \text{ kg/t pig iron} \quad (12a)$$

total amount of pig iron $$MPI = 100.2 \text{ t} \quad (12b)$$

(m) Total charging materials

| | | | | |
|---|---|---|---|---|
| (13a) | scrap | MSC | = | 24.4 t |
| | lime | $M_K$ | = | 4053.0 kg |
| | blowing oxygen | $VO_2$ | = | 5490 $Nm^2$ |

with 100 kg fluor spar 1000 kg granulated slag and 4500 kg solid pig iron added, noting that there result 8.55 t slag in total and (13b)

7813 $Nm^3$ waste gases in total.

What we claim is:

1. In a process for piloting a steel refining process for the production of low carbon steels having a carbon content below 0.1 percent by weight, comprising charging all charging materials into the refining vessel at the beginning of the refining process and blowing oxygen into the refining vessel in an amount sufficient to produce an FeO content in the slag contained in said refining vessel which FeO content is effective for slagging the Mn and P; the improvement comprising producing an FeO content in the slag which is in excess of the stoichiometric amount of FeO necessary for slagging both P and Mn contained in the slag; and adding an amount of lime which corresponds to saturation of lime and dicalcium silicate in the quasi-ternary system $(CaO)'$—$(FeO)'$—$(SiO_2)'$ wherein during said process the basicity of the slag is greater than 2.8; wherein the Mn content of the crude steel is at least 0.20 percent by weight and the maximum P content of the crude steel is 0.03 percent.

2. The process of claim 1, wherein lime is added to the slag to treat the amount of FeO in excess of said stoichiometric quantity to establish an FeO content in the slag which ranges from 191.193-0.103T, wherein T is the final temperature of the contents of the refining vessel in ° C.

* * * * *